United States Patent [19]

McLaughlin, Jr.

[11] Patent Number: 4,515,054

[45] Date of Patent: May 7, 1985

[54] CUTTER WHEEL FOR CUTTING CONTINUOUS TOW

[75] Inventor: William D. McLaughlin, Jr., Charlotte, N.C.

[73] Assignee: Celanese Corporation, New York, N.Y.

[21] Appl. No.: 472,560

[22] Filed: Mar. 7, 1983 (Under 37 CFR 1.47)

[51] Int. Cl.[3] ..... D01G 1/04

[52] U.S. Cl. ..... 83/663; 83/346; 83/698; 83/913

[58] Field of Search ..... 83/346, 347, 913, 663, 83/665, 674, 678, 403

[56] References Cited

U.S. PATENT DOCUMENTS

| | | | |
|---|---|---|---|
| 3,777,610 | 12/1973 | Spaller, Jr. | 83/913 X |
| 3,831,481 | 8/1974 | Van Doorn et al. | 83/913 X |
| 4,248,114 | 2/1981 | Alexander et al. | 83/347 |
| 4,249,441 | 2/1981 | Sturtz | 83/347 |

*Primary Examiner*—James M. Meister
*Assistant Examiner*—John L. Knoble
*Attorney, Agent, or Firm*—S. M. Bodenheimer, Jr.

[57] ABSTRACT

A cutting wheel for cutting continuous filamentary tow comprises first and second axially spaced carrier plates which are rotatable about a common axis. An annular row of cutter blades extends between the carrier plates, each blade having a radially outwardly facing cutting edge for cutting the tow. At least four connecting plates have opposite ends affixed to respective carrier plates to prevent mutual separation of the carrier plates in the axial and radial directions. Each connecting plate is aligned with an associated one of the blades and is positioned radially inwardly relative thereto and has a thickness substantially the same as that of the associated blade. The connecting blades as a group provide a substantial portion of the resistance against mutual separation of the carrier plates in the axial and radial directions. The blades as a group transmit a substantial portion of the torque between the carrier plates.

18 Claims, 3 Drawing Figures

CUTTER WHEEL FOR CUTTING CONTINUOUS TOW

BACKGROUND OF THE INVENTION

The invention relates to the cutting of continuous filamentary tow into staple lengths, and in particular to the high speed cutting of crimped or uncrimped tow into lengths of $\frac{3}{4}$ inch or shorter.

Cutters have been heretofore proposed for cutting a continuous filamentary tow of man-made fiber, such as polyester, for example, into staple lengths. Exemplary of such proposals are the disclosures of U.S. Pat. No. 3,485,120 issued to Keith on Dec. 23, 1969, U.S. Pat. No. 3,831,481 issued to Van Doorn et al on Aug. 27, 1974, and U.S. Pat. No. 3,733,945 issued to Cook on May 22, 1973.

In the Keith patent, for example, there is disclosed a cutter wheel which comprises a pair of interconnected upper and lower circular plates which are spaced in the direction of the axis of rotation of the wheel. The wheel is provided with a circular array of cutter blades which have sharpened edges and are oriented parallel to the axis of rotation and facing radially outwardly. The spacing between adjacent cutting edges corresponds to the desired length of cut of the tow. Each blade is mounted to a support post, the posts having their ends connected to the plates and thereby serving to interconnect the plates. The posts provide substantially all of the resistance to separation of the plates in the radial and axial directions. The upper plate is rotatably driven, with rotary motion being transmitted therefrom to the lower plate primarily by the support posts. As the reel is rotated, a continuous-length tow is wrapped around the periphery of the cutting edges of the blades. As the radial thickness of the two builds-up, a pressure roller presses the tow radially inwardly past the blades so that the tow is served into the desired lengths. The severed tow fibers pass into the wheel and exit via a center opening in the lower plate.

In the Van Doorn et al patent it is proposed to interconnect the plates by means of a plurality of posts that are spaced radially inwardly of the blades from between $\frac{1}{8}$ inch to $1\text{-}\frac{1}{2}$ inch. There are fewer posts provided than the number of blades. The sides of each post is divergent in a radially inward direction to define a generally wedge-shaped post.

It has been proposed in Spaller U.S. Pat. No. 3,777,610 issued Dec. 11, 1973 to interconnect the upper and lower plates solely by means of the blades themselves (i.e., omit the support posts). However, in such an arrangement the blades would be unable to resist the substantial axial forces which tend to separate the plates in the axial direction, unless substantially reinforced. Such reinforcement, however, could unduly complicate individual removal and replacement of the blades.

While cutting wheels of the type illustrated in the Van Doorn et al and Keith patents have performed acceptably when cutting tow into lengths longer than about $\frac{1}{2}$ inch, problems have been encountered when attempting to cut uncrimped tow into lengths less than $\frac{1}{2}$ inch. It has been found that the cut fibers tend to "pack" within the the cutter wheel. Eventually, the packed fibers build-up to such an extent that the wheel becomes clogged and further cutting is rendered impossible. Accordingly, the cutter must be shut down and the clog removed. Such a problem has been experienced at low throughput speeds and to a greater extent at high throughput speeds (e.g., at or greater than 450 fpm tow velocity). One cause of this problem is the obstruction to fiber flow which is presented by support posts which extend beyond the sides of the blades and into the fiber throughflow passages. Unless the rotary speed of the cutter wheel is slowed, there may result a complete blockage of the throughflow passages and/or a mutual separation of the plates in the axial direction. Furthermore, the radial forces which must be exerted upon the fibers by the pressure rollers is increased, thereby accelerating the rate of wear of the cutting edges. Such wear results in a greater amount of broken ends occurring on the cut tow, thereby adversely affecting quality.

In copending application Ser. Nos. 343,241 and 343,242 of Waite et al and Glick, respectively, each filed Jan. 27, 1982, it has been proposed to cut the tow while wet and to interconnect the upper and lower plates by means of connector arms which define a clearance inwardly of the blade to accommodate free inward travel of the tow. As a result, the tow is cut with less change of flow blockage and at high throughput speeds. Notwithstanding the improved cutting performance resulting from these proposals, room for further improvement remains, especially in the area of resisting the axial forces which tend to mutually separate the plates.

SUMMARY OF THE INVENTION

The present invention relates to a cutting wheel for cutting continuous filamentary tow. The cutting wheel comprises first and second carrier plates. The plates are rotatable about a common axis and are mutually spaced in the axial direction. The second carrier plate defines a central exit opening. An annular row of cutter blades is provided, the blades extending between the first and second carrier plates. The blades have radially outward facing cutting edges such that as filamentary tow is wrapped around the row of blades and pushed thereagainst, the tow is cut by the cutting edges and passes between the blades. At least four connecting plates are provided having opposite ends affixed to respective carrier plates to prevent mutual separation of the carrier plates in the axial and radial directions. Each connecting plate is aligned with an associate one of the blades and is positioned radially inwardly and relative to the associated blade and has a thickness substantially the same as that of the associated blade. The connecting plates as a group provide a substantial portion of the resistance against mutual separation of the carrier plates in the axial and radial directions. The blades as a group transmit a substantial portion of the torque between the carrier plates.

Preferably, the second carrier plate includes an annular wall defining the central exit opening. A plurality of radially elongate projections extend radially inwardly from the wall, with lower ends of the connecting plates being seated on the projections.

Preferably, the first and second carrier plates include pairs of radially closed, longitudinally open slits aligned in a direction parallel to the rotary axis. Each pair of aligned slits receives one of the blades. A removable retainer plate is mounted on one of the carrier plates to retain the blades within the slits.

Preferably, the blades are mounted so as to be non-tensioned in the presence of forces tending to separate the carrier plates in the axial direction.

Preferably, the connecting plates are spaced radially inwardly from the associated blades, so as to avoid interfering with beam-type deflection of the blade.

THE DRAWING

The advantages of the present invention will become apparent from the following detailed description of a preferred embodiment thereof, in connection with the accompanying drawings in which like numerals designate like elements, and in which.

DETAILED DESCRIPTION OF A PREFERRED EMBODIMENT OF THE INVENTION

Figure 1:
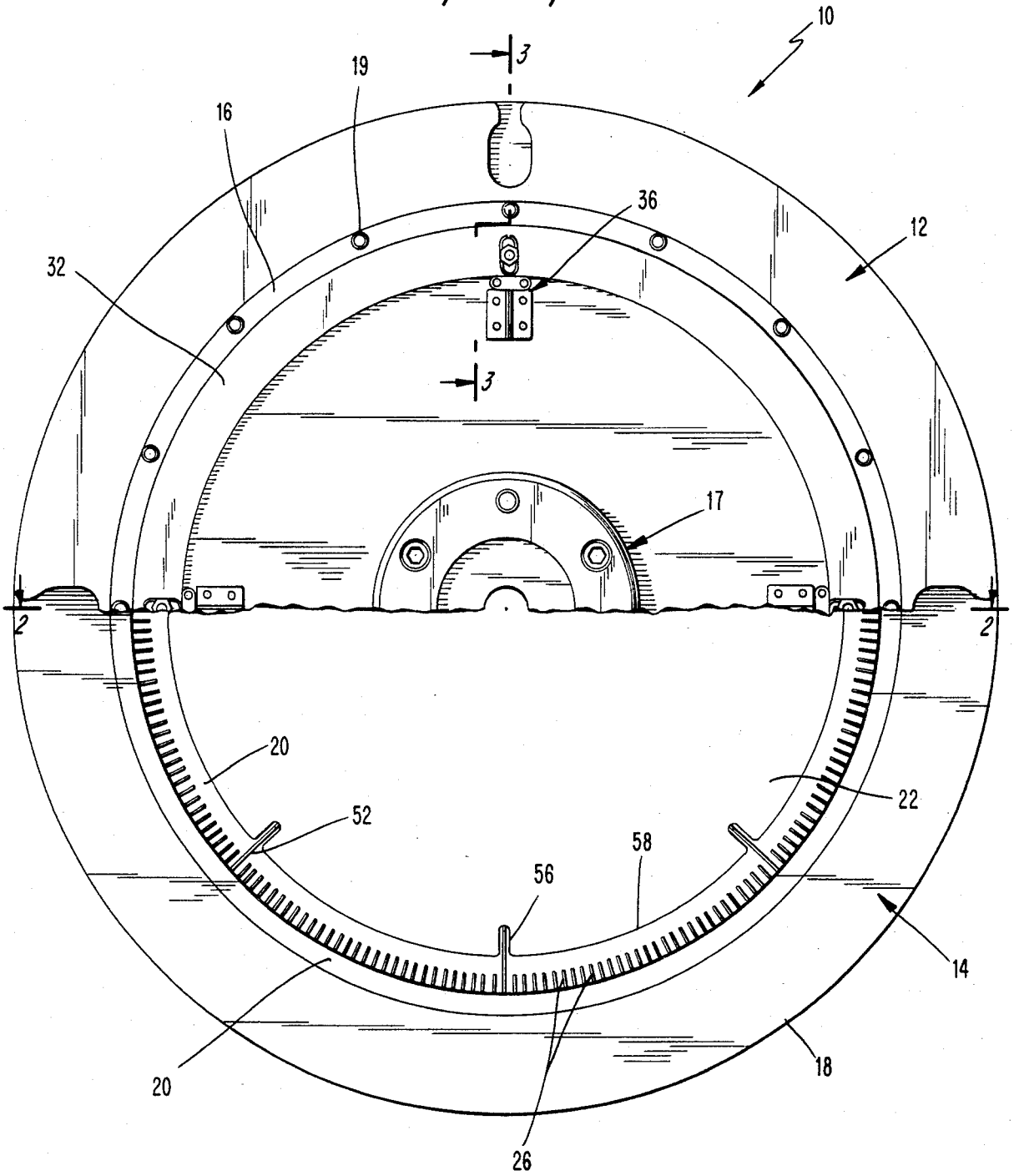
FIG. 1 is an upper plan view of a cutter wheel according to the present invention, with one-half of an upper carrier plate thereof removed to expose the cutter blades and connecting plates.
Figure 2:
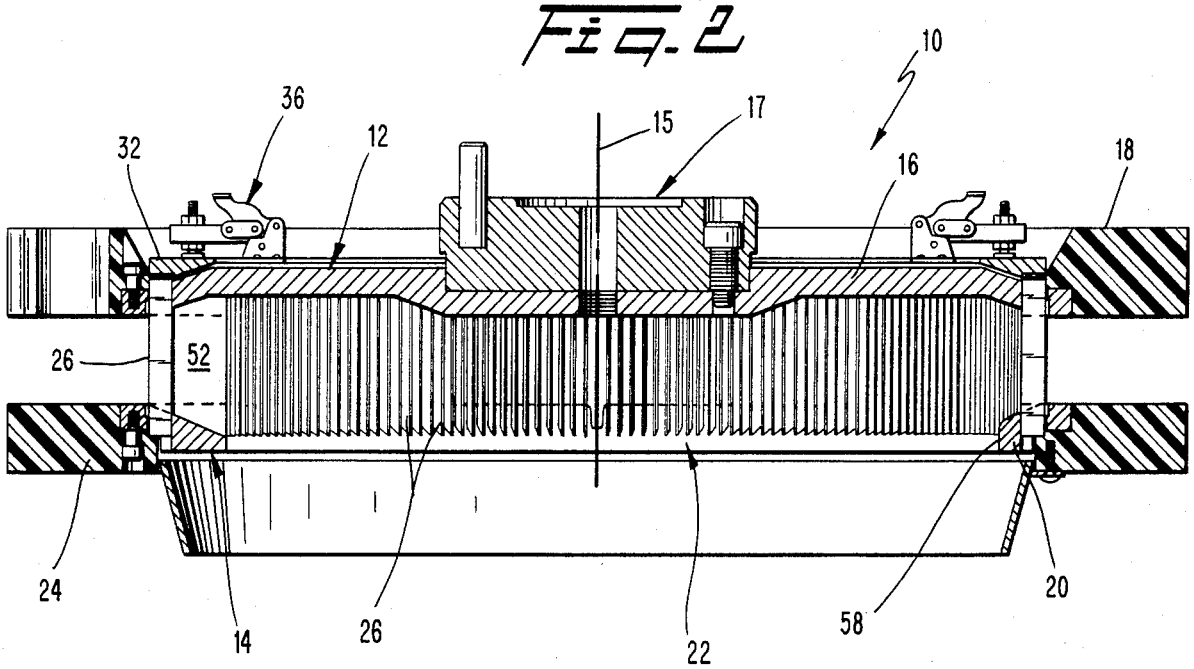
FIG. 2 is a longitudinal sectional view taken along line 2—2 in FIG. 1.
Figure 3:
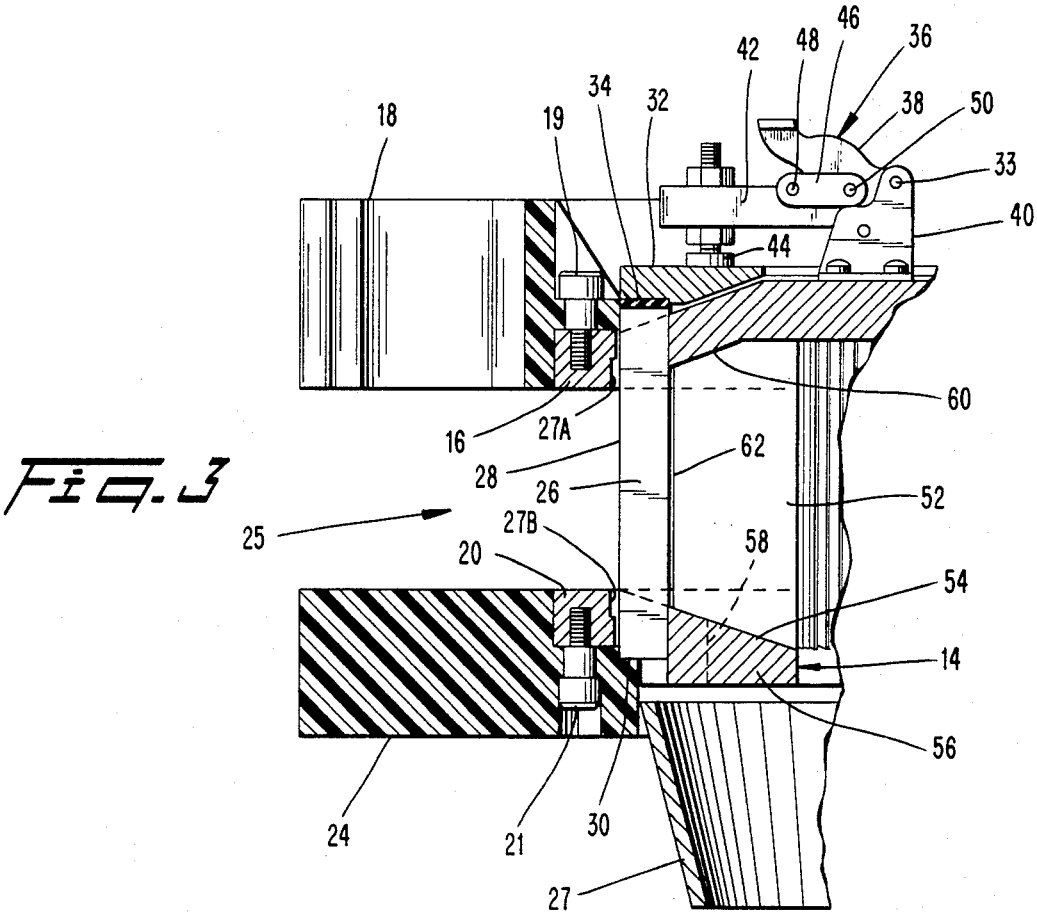
FIG. 3 is a longitudinal sectional view taken through an outer periphery of the cutting wheel, along line 3—3 of FIG. 1.

As depicted in FIGS. 1 and 2, a cutter wheel 10 for cutting filamentaryy tow comprises first and second circular carrier plates 12, 14. Customarily, the wheel 10 is oriented such that the carrier plates 12, 14 are disposed in horizontal planes, the first carrier plate 12 overlying the second carrier plate 14. Hence, the carrier plates will hereinafter be designated as upper and lower carrier plates 12, 14, respectively. The carrier plates are to be rotated about an axis of rotation 15, the carrier plates 12, 14 being mutually spaced in the axial direction.

The upper carrier plate 12 comprises a metal body 16 and an outer rim 18 mounted on the outer periphery thereof by fasteners such as screws 19. A conventional coupling 17 is mounted on the carrier plate 16 for connection to a rotary drive shaft (not shown). The rim 18 is preferably formed of a plastic material such as micarta. The lower carrier plate 14 comprises a ring-shaped portion 20 preferably of metal which defines a large central opening 22 for the exiting of cut tow. An outer rim 24 of plastic material is secured to the outer periphery of the ring 20 by screws 21 or other fasteners and has substantially the same outer diameter as that of the outer rim 18 of the upper carrier plate 12. The body 16 and the ring-shaped portion 20 are preferably formed of steel, although other suitable materials can be employed. The upper and lower rims 18, 24 define an annular inlet passage 25 for tow. A cone-shaped deflector 27 can be secured to the lower rim 24.

The wheel includes a circular row of cutter blades 26. The blades 26 have their upper and lower ends mounted in aligned slits 27A, 27B in the upper body 16 and lower ring 20. The slits are closed in the radial direction but open in the longitudinal direction, i.e., a direction parallel to the axis of rotation 15. Thus, the blades are inserted longitudinally into the slits. The cutting edges 28 of the blades extend parallel to the rotary axis of the sheel, i.e., vertically during normal cutting operations of the wheel.

The lower rim 24 includes a radially disposed ledge 30 extending around the inner circumference of the rim at a location spaced longitudinally downwardly from the inlet passage 25 defined by the upper and lower rims 18, 24. This ledge 30 defines a seat upon which the lower ends of the blades 26 rest. Upper ends of the blades are pressed against the ledge 30 by means of a retainer ring 32. This retainer ring is configured to overlie the slits 27A of the upper carrier plate 12. A resilient gasket 34, preferably formed of rubber, is formed on the underside of the retainer ring. This gasket 34 presses against the upper ends of the blades 26 to resist blade chatter and insure that excessive lengthwise forces are not imposed upon the blades which could cause the blades to buckle to an excessive extent.

Releasable pressure clamps 36 are mounted upon the upper carrier plate 12 to press downwardly against the retainer ring 32. Each clamp comprises a handle 38 which is pivotably mounted at 33 to a bracket 40 affixed to the upper carrier plate 12. The handle rotates within a vertical plane containing the rotary axis of the wheel. Also connected to the bracket for rotation in the same plane is a clamp arm 42. A free end of the clamp arm carries an adjustable pressure pad 44. A link 46 pivotably interconnects the handle and the clamp arm such that rotary movement of the handle is transmitted to the clamp arm to swing the free end of the latter upwardly and downwardly. The link pivots 48, 50 are aligned with the pivot 33 of the handle 30 such that the handle and link from a toggle linkage which maintains the clamp arm in a downward or pressing position when the handle is rotated toward the clamp arm. Thus by moving the handle 38 to a closed position, the pressure pad 44 presses the retaining ring 34 against the blades 26. When the handle is released (i.e., swung to an open position), the retaining ring can be removed, allowing replacement of the blades.

It will be appreciated that other types of clamps can be employed to press the retaining ring 34 against the blades.

Due to the manner in which the blades are mounted, they will not be tensioned in the presence of forces tending to axially separate the blades, and thus will not resist such separation.

Interconnecting the upper and lower carrier plates 12, 14 are a plurality of thin connecting plates 52 which are oriented in vertical radial planes, each such plane containing a blade 26 disposed in radial alignment with the plate 52.

A lower end of each connecting plate 52 rests upon an upper surface 54 of a projection 56 which extends radially inwardly from an inner wall 58 of the ring 20. Each upper surface 54 is inclined relative to the radial direction so as to extend inwardly and downwardly from the wall 58.

The upper end of each connecting plate has a front bevel 60 which engages a correspondingly beveled surface on the underside of the upper carrier plate 16.

The upper and lower ends of the connecting plates 52 are rigidly fastened, as by welding, for example, to the beveled surface of the upper carrier plate and the upper surfaces 54 of the projections 56 to prevent mutual separation of the carrier plates in axial and radial directions.

The connecting plates 52 are preferably spaced slighly inwardly of the associated blade, leaving a slight gap 62 therebetween (e.g., at least 0.015 inch), so as not to interfere with beam-type deflection of the blade.

The thickness of each connecting plate 52 is substantially the same as the thickness of the blade 26, to minimize the extent to which the connecting plate 52 extends laterally beyond the sides of the associated blades 26 and avoid blockage of the flowthrough passes between adjacent blades. For example, in one cutter wheel arrangement, cutter blades are formed of heat treated M2 tool steel and are 0.037 inches thick and the connecting plates are 0.040 inches thick. Thus, the connecting plates each overlie about only 0.57% of the space between adjacent blades and create no appreciable blockage of those spaces. Preferably, such an overlie percentage should be no greater than about 1.0%.

It will be appreciated that since only a few connecting plates are provided, the projections are also few in number and thus do not block the central opening to any appreciable degree. At least four connecting plates are required, although eight equally spaced connecting plates formed of high carbon steel are preferable.

In practice, the connecting plates provide substantially all of the resistance against mutual separation of the carrier plates in the axial and radial directions. The blades 26 are incapable of providing any appreciable resistance in those directions, due to the manner in which they are mounted.

The connecting plates 52 are, by themselves, unable to transmit all of the necessary torsional forces from the upper carrier plate 12 to the lower carrier plate 14 as the wheel is being driven. Thus, the major part of the torsional loading (e.g., about 95%) is borne by the blades 26 as a group. As a result, there is a tendency for the blades to twist slightly about their longitudinal axes during rotation of the cutter wheel. In practice, then, the upper carrier plate 12 is rotationally advanced slightly relative to the lower carrier plate 14 during operation.

In practice, the cutting wheel according to the present invention has been successfully operated to cut tow into short staple, e.g., $\frac{1}{4}$ to $\frac{1}{2}$ inch, at high speed, e.g., at least 450 fpm linear tow speed, without the cut fiber clogging the wheel. Contributing to this improved performance is the lack of any appreciable obstruction of the cut staple while passing from the blades to the exit opening 22. The smooth unobstructed flow of staple results also in lower pressures needed to push the tow through the blades, thereby reducing the cutting forces and blade wear, and may contribute to the improved quality of cut fiber which has been detected, i.e., more cleanly cut fibers.

The blades 26 and connecting plates 52 cooperate in a unique manner to insure the integrity of the wheel. That is, the connecting plates as a group provide substantially all of the resistance against mutual separation of the carrier plates in the radial and axial directions as the tow is pressed therebetween, whereas most of the torque which is transmitted from the upper carrier plate 12 to the lower carrier plate 14 is transmitted by the blades as a group. This cooperation enables very thin connecting plates to be employed which do not obstruct the flowthrough of cut fiber as noted above. Moreover, these advantages are achieved without diminishing the ability to conveniently replace individual ones of the blades 26 when necessary.

Although the advantages of the present invention have been described in connection with a preferred embodiment of the invention, it will be appreciated by those skilled in the art that additions, modifications, substitutions, and deletions may be made, without departing from the spirit and scope of the present invention, as defined in the appended claims.

What is claimed is:

1. A cutting wheel for cutting continuous filamentary tow, comprising:

first and second carrier plates, said plates being rotatable about a common axis and being mutually spaced in the axial direction, said second carrier plate defining a central exit opening, an annular row of cutter blades extending between said first and second carrier plates, said blades having radially outwardly facing cutting edges such that as filamentary tow is wrapped around said row of blades and pushed thereagainst, the tow is cut by said cutting edges and passes between said blades, at least four connecting plates having opposite ends affixed to respective carrier plates to prevent mutual separation of said carrier plates in the axial and radial directions, each connecting plate being aligned with an associated one of said blades, each connecting plate being positioned radially inwardly relative to the associated blade and having a thickness substantially the same as that of said associated blade, said connecting plates as a group providing a substantial portion of the resistance against mutual separation of said carrier plates in the axial and radial directions, said blades as a group transmitting a substantial portion of the torque between said carrier plates.

2. A cutting wheel according to claim 1, wherein said blades are removably mounted in said first and second carrier plates for individual replacement, and releasable means retaining said blades against withdrawal.

3. Apparatus according to claim 1, wherein said second carrier plate includes an annular wall defining said central exit opening, a plurality of radially elongate projections extending radially inwardly from said wall, lower ends of said connecting plates being seated on said projections.

4. Apparatus according to claim 1, wherein opposite ends of each said connecting plate are welded to said carrier plates.

5. Apparatus according to claim 1, wherein said first and second carrier plates include pairs of radially closed, longitudinally open slits aligned in a direction parallel to said rotary axis, each pair of aligned slits receiving one of said blades, and a removable retainer plate mounted on one of said carrier plates to retain said blades within said slits.

6. Apparatus according to claim 1, wherein there are eight of said connecting plates spaced uniformly around the periphery of said wheel.

7. Apparatus according to claim 1, wherein said blades aremounted so as to be non-tensioned in the presence of forces tending to separate said carrier plates in the axial direction.

8. Apparatus according to claim 1, wherein said connecting plates are spaced radially inwardly from said associated blades.

9. Apparatus according to claim 1, wherein the connecting plates overlie no more than 1% of the spacing between adjacent blades.

10. A cutting wheel for cutting continuous filamentary tow, comprising:

first and second carrier plates rotatable about a common axis and mutually spaced in the axial direction, said second carrier plate defining a central tow exit opening, an annular array of cutter blades extending between said carrier plates, said blades having radially outwardly facing cutting edges such that as filamentary tow is wrapped around said array of blades and pushed thereagainst, the tow is cut by said cutting edges and passes between said blades, a plurality of thin connecting plates having opposite ends affixed to respective carrier plates to prevent mutual separation of said carrier plates in the axial and radial directions, each connecting plate being aligned with an associated one of said blades, the radial extent of each connecting plate being longer than the thickness thereof and such thickness being substantially the same as the thickness of said associated blade, such that said connecting plates present no appreciable obstruction to the passage of cut tow and are flexible in the torsional direction, said blades as a group transmitting a substantial portion of the torque between said carrier plates, and said connecting plates as a group providing a substantial portion of the resistance against mutual separation of said carrier plates in the axial and radial directions.

11. A cutting wheel according to claim 10, wherein said blades are removably mounted in said first and second carrier plates for individual replacement, and releasable means retaining said blades against withdrawal.

12. Apparatus according to claim 10, wherein said second carrier plate includes an annular wall defining said tow exit opening, a plurality of radially elongate projections extending radially inwardly from said wall, lower ends of said connecting plates being seated on said projections.

13. Apparatus according to claim 10, wherein opposite ends of each said connecting plate are welded to said carrier plates.

14. Apparatus according to claim 10, wherein said first and second carrier plates include pairs of slits aligned in a direction parallel to said rotary axis, each pair of aligned slits receiving one of said blades, and a removable retainer plate mounted on one of said carrier plates to retain said blades within said slits.

15. Apparatus according to claim 10, wherein there are eight of said connecting plates spaced uniformly around the periphery of said wheel.

16. Apparatus according to claim 10, wherein said blades are mounted so as to be non-tensioned in the presence of forces tending to separate said carrier plates in the axial direction.

17. Apparatus according to claim 10, wherein said connecting plates are spaced radially inwardly from said associated blades.

18. A cutting wheel for cutting continuous filamentary tow, comprising:

first and second carrier plates, said plates being rotatable about a common axis and mutually spaced in the axial direction, said second carrier plate having an annular wall defining a central tow exit opening and a plurality of circumferentially spaced projections extending radially inwardly therefrom, drive means connected to said first carrier plate for transmitting rotary forces thereto, an annular row of cutter blades extending between said first and second carrier plates, said blades having radially outwardly facing cutting edges such that as filamentary tow is wrapped around said row of blades and pushed inwardly thereagainst, the tow is cut by said cutting edges and passes between said blades, a retainer removably clamped onto one of said carrier plates and arranged to retain said blades against removal from said carrier plates, removal of said retainer permitting selective removal of all of said blades, at least four connecting plates each having one end welded to a respective one of said projections, and the other end welded to said first carrier plate to prevent mutual separation of said carrier plates in the radial and axial directions, each connector plate disposed within a radial plane containing said common axis and an associated one of said blades, each connecting plate being spaced radially inwardly from said associated blade and having a thickness substantially the same as that of said associated blade, said connecting plates as a group providing all of the resistance against mutual separation of said carrier plates in the radial and axial directions, said blades, as a group, transmitting a substantial portion of the torque between said carrier plates, and being mounted so as to be non-tensioned in the presence of forces tending to separate said carrier plates in the axial direction.

* * * * *